United States Patent [19]

Nishikawa

[11] Patent Number: 4,475,828

[45] Date of Patent: Oct. 9, 1984

[54] SMALL PRINTER

[75] Inventor: Tatsuo Nishikawa, Tachikawa, Japan

[73] Assignee: Canon Kabushiki Kaisha, Tokyo, Japan

[21] Appl. No.: 493,744

[22] Filed: May 11, 1983

Related U.S. Application Data

[63] Continuation of Ser. No. 258,418, Apr. 28, 1981, abandoned.

[30] Foreign Application Priority Data

Jul. 31, 1980 [JP] Japan ..... 55-104405

[51] Int. Cl.[3] ..... B41J 1/20

[52] U.S. Cl. ..... 400/146; 400/174; 101/93.13; 101/111; 101/368

[58] Field of Search ..... 400/174; 101/93.13, 101/110, 111, 360

[56] References Cited

U.S. PATENT DOCUMENTS

| | | | |
|---|---|---|---|
| 1,964,455 | 6/1934 | Cook | 101/368 |
| 2,699,112 | 1/1955 | Robinson, Jr. | 101/111 |
| 2,762,297 | 9/1956 | Baer | 101/93.13 |
| 3,223,033 | 12/1965 | Sundblad | 101/368 |
| 3,611,412 | 10/1971 | Gibby | 400/174 |
| 3,717,234 | 2/1973 | Koller | 400/174 |
| 3,734,012 | 5/1973 | Huggins | 101/10 B |
| 3,769,626 | 10/1973 | McClenahan | 400/146 |
| 3,844,395 | 10/1974 | Mero et al. | 400/620 |
| 3,884,339 | 5/1975 | Castaldi | 400/144.3 |
| 4,043,440 | 8/1977 | Busch | 400/620 |
| 4,178,107 | 12/1979 | Guerrini | 400/174 |
| 4,258,624 | 3/1981 | Mitshi | 101/110 |

FOREIGN PATENT DOCUMENTS

| | | | |
|---|---|---|---|
| 2556944 | 6/1977 | Fed. Rep. of Germany | 400/551 |
| 2819140 | 10/1979 | Fed. Rep. of Germany | 400/185 |
| 1282558 | 7/1972 | United Kingdom | 400/551 |

*Primary Examiner*—William Pieprz

*Attorney, Agent, or Firm*—Fitzpatrick, Cella, Harper & Scinto

[57] ABSTRACT

There is provided a small printer capable of effecting printing in two colors by a simple structure. The small printer comprises a base formed in a cylindrical shape, a plurality of places of printing type belts mounted on the outer peripheral surface of the base, two sets of printing type groups of the same pattern formed on the printing type belts circumferentially thereof, hammer units corresponding to the printing type belts and contained in the base, and a pair of ink rollers capable of applying inks of distinct colors to the different printing type groups formed on the printing type belts.

4 Claims, 29 Drawing Figures

(A)
CALCULATING FORMULA

```
    1 2 3'0 0 0
-)  2 2 3'0 0 0
-------------
-   1 0 0'0 0 0
```

(B)
PRINTING FORMAT-(1)

```
    1 2 3'0 0 0 +  (VIOLET)
    2 2 3'0 0 0 -  (VIOLET)
-   1 0 0'0 0 0    (VIOLET)
```

(C)
PRINTING FORMAT-(2)

```
    1 2 3'0 0 0 +  (VIOLET)
    2 2 3'0 0 0 -  (VIOLET)
-   1 0 0'0 0 0    ( RED )
```

FIG. 1

(A)
PRINTING FORMAT (1) 1 2 3 4 5 6 7 8 9

(B)
PRINTING FORMAT (2) 2 3 4 5 6 7 8 9

(C)
PRINTING FORMAT (3) 1 2 3'4 5 6'7 8 9

FIG. 2

FOR ONE REVOLUTION OF PRINTING TYPE DRUM

| ROW NO. \ COLUMN NO. | 18 | 17 | 16 | 15 | 14 | 13 | 12 | 11 | 10 | 9 | 8 | 7 | 6 | 5 | 4 | 3 | 2 | 1 | | |
|---|---|---|---|---|---|---|---|---|---|---|---|---|---|---|---|---|---|---|---|---|
| 0 | | | | | | | | | | | | | | | | | | | | |
| 1 | 1 | 1 | 1 | 1 | 1 | 1 | 1 | 1 | 1 | 1 | 1 | 1 | 1 | 1 | 1 | 1 | 1 | E | M+ | NO. 1 CHARACTER GROUP (VIOLET) |
| 2 | 2 | 2 | 2 | 2 | 2 | 2 | 2 | ··· | ··· | ··· | | | | | 2 | 2 | 2 | D | + | |
| 3 | 3 | 3 | 3 | 3 | ··· | ··· | ··· | ··· | | | | | | | | 3 | 3 | R | − | |
| 4 | 4 | 4 | 4 | 4 | ··· | ··· | ··· | ··· | | | | | | | | 4 | 4 | A | × | |
| 5 | 5 | 5 | 5 | 5 | ··· | ··· | ··· | ··· | | | | | | | | 5 | 5 | G | ÷ | |
| 6 | 6 | 6 | 6 | 6 | ··· | ··· | ··· | ··· | | | | | | | | 6 | 6 | $\overline{K}$ | = | |
| 7 | 7 | 7 | 7 | 7 | ··· | ··· | ··· | ··· | | | | | | | | 7 | 7 | K | % | |
| 8 | 8 | 8 | 8 | 8 | ··· | ··· | ··· | ··· | | | | | | | | 8 | 8 | U | ◇ | |
| 9 | 9 | 9 | 9 | 9 | ··· | ··· | ··· | ··· | | | | | | | | 9 | 9 | P | ✳ | |
| 10 | 0 | 0 | 0 | 0 | ··· | ··· | ··· | ··· | | | | | | | | 0 | 0 | √ | S | |
| 11 | # | • | • | • | ··· | ··· | ··· | ··· | | | | | | | | ∘ | ∘ | C | T | |
| 12 | − | − | − | − | ··· | ··· | ··· | ··· | | | | | | | | − | − | − | M− | |
| 13 | ' | ' | ' | ' | ' | ' | ' | ' | ' | ' | ' | ' | ' | ' | ' | ' | ' | Δ | Δ | |
| 14 | | | | | P | | | | | | | | | | | | | | | |
| 15 | 1 | 1 | 1 | 1 | 1 | 1 | 1 | 1 | 1 | 1 | 1 | 1 | 1 | 1 | 1 | 1 | 1 | E | M+ | NO. 2 CHARACTER GROUP (RED) |
| 16 | 2 | 2 | 2 | 2 | ··· | ··· | ··· | ··· | | | | | | | | 2 | 2 | D | + | |
| 17 | 3 | 3 | 3 | ··· | ··· | ··· | ··· | | | | | | | | | 3 | 3 | R | − | |
| 18 | 4 | 4 | 4 | ··· | ··· | ··· | ··· | | | | | | | | | 4 | 4 | A | × | |
| 19 | 5 | 5 | 5 | ··· | ··· | ··· | ··· | | | | | | | | | 5 | 5 | G | ÷ | |
| 20 | 6 | 6 | 6 | ··· | ··· | ··· | ··· | | | | | | | | | 6 | 6 | $\overline{K}$ | = | |
| 21 | 7 | 7 | 7 | ··· | ··· | ··· | ··· | | | | | | | | | 7 | 7 | K | % | |
| 22 | 8 | 8 | 8 | ··· | ··· | ··· | ··· | | | | | | | | | 8 | 8 | U | ◇ | |
| 23 | 9 | 9 | 9 | ··· | ··· | ··· | ··· | | | | | | | | | 9 | 9 | P | ✳ | |
| 24 | 0 | 0 | 0 | ··· | ··· | ··· | ··· | | | | | | | | | 0 | 0 | √ | S | |
| 25 | # | • | • | ··· | ··· | ··· | ··· | | | | | | | | | ∘ | ∘ | C | T | |
| 26 | − | − | − | ··· | ··· | ··· | ··· | | | | | | | | | − | − | − | M− | |
| 27 | ' | ' | ' | ' | ' | ' | ' | ' | ' | ' | ' | ' | ' | ' | ' | ' | ' | Δ | Δ | |

FIG. 6

SMALL PRINTER

This is a continuation of application Ser. No. 258,418, filed Apr. 28, 1981, now abandoned.

BACKGROUND OF THE INVENTION

1. Field of the Invention

This invention relates to a small printer, and more particularly to a small printer constructed so as to be capable of effecting printing in two different colors.

2. Description of the Prior Art

With the conventional small printers used in electronic desk-top calculators, it has not been possible that ink ribbons of two colors are provided so that during printing, the positions of the ink ribbons are shifted to enable printing in two colors to be done in accordance with the colors of the ink ribbons.

Printing in two colors in particularly effective is the case where the result of a calculation is negative (−) such as 123,000–223,000 = −100,000 as shown in FIG. 1(A) of the accompanying drawings. That is, in such a case, when the result of a calculation is negative (−) and has been printed only in the same ink and therefore, there has been no other way to detect a negative result other than visually confirming the sign (−). FIG. 1(B) of the accompanying drawings shows the printing format effected in the same color, for example, violet, in such a case.

Accordingly, in such a case where printing is effected in the same color, making an oversight of the sign (−) would be fatal. Particularly, in shops or stores where the sales for each day are continuously printed on a roll of paper, the amount of printing would be enormous and summing up the sales for each day would require much labor and time.

However, if, as shown in FIG. 1(C) of the accompanying drawings, the sign and the result of calculation are printed in a different color such as, for example, red, when the result of calculation is negative (−), it would be very easy to judge the result. This would also be excellent engineering advancement.

On the other hand, where the number of printed digits is nine and an attempt is made to indicate a number of nine figures using a conventional printing type belt, there will result a printing format such as "1 2 3 4 5 6 7 8 9" as shown in FIG. 2A without demarcation of every three figure units. In such a case, if an attempt is made to print the number with a space provided at every three figures, two figures cannot be printed as indicated by dotted lines in FIG. 2B of the accompanying drawings because the number of total print figures is nine. In such a case, if a design is made such that the marks "," can be printed without a space being provided to separate each unit as shown in FIG. 2C of the accompanying drawings, all three figure units can be seen and seen at a glance.

Also, assuming that the position whereat printing is effected by a printing type drum D is A as shown in FIG. 3A of the accompanying drawings and if the angle $\beta$ formed between the position B of a character printed after printing and printing paper C and the straight line L passing through the point B and the upper surface of the printing type drum D, the angle $\beta$ being called the visibility angle, is small, then the printing type drum D will obstruct the view of the printed character.

Generally, to make this visibility angle $\beta$ great, the diameter of the printing type drum may be made small and therefore, the printing type drum is constructed as small as possible. However, making the printing type drum small would cause characters printed thereby to be small and would reduce the quality of printing. Therefore, usually, the amount of paper feed P is increased as shown in FIG. 3B of the accompanying drawings to thereby increase the visibility angle $\beta$, whereas increasing the amount of paper feed P would increase the amount of consumption of paper and is very uneconomical.

Therefore, if a character printed at $P_1$ is moved to a point $P_2$ as shown in FIG. 3C of the accompanying drawings, the visibility angle $\beta$ will become very great. If, thereafter, the printed character is moved back to a point $P_3$ during the next cycle of printing, the amount of consumption of paper will be reduced.

For example, if $P_1=0$ mm and $P_2=25$ mm and the distance from $P_2$ to $P_3$ is 20 mm, then the amount of consumption of paper will be only 5 mm.

SUMMARY OF THE INVENTION

It is therefore an object of the present invention to provide a small printer which is capable of effecting printing in two colors by a simple construction.

It is another object to provide a small printer which is capable of accurately feeding printing paper without requiring an expensive drive source such as a pulse motor.

It is still another object of the present invention to provide a small printer having a printing format in which units are clear.

It is yet still another object of the present invention to provide a small printer in which the angle of visibility can be increased.

To achieve the above objects, the present invention adopts a construction in which ink rolls of two colors adapted to alternately contact printing type belts wrapped around a printing type drum, are provided to realize a printing format comprising two different colors as required. Further, the printing paper can be reliably fed by the use of a spring clutch, without an expensive drive source such as a pulse motor being required. Unit marks can be printed at every three digits or figures of a printed number. The printing paper can be fed at a great pitch after printing to increase the visibility angle, and during printing, the printing paper can be moved back to a predetermined printing position to thereby save consumption of the printing paper.

The invention will hereinafter be described more fully with respect to an embodiment thereof shown in the accompanying drawings.

BRIEF DESCRIPTION OF THE DRAWINGS

FIGS. 1(A)–1(C) illustrate a calculation and printing formats.

FIGS. 2A–2C illustrate different printing formats.

FIG. 6 is a developed view of a printing type belt.

DESCRIPTION OF THE PREFERRED EMBODIMENT

Figure 4:
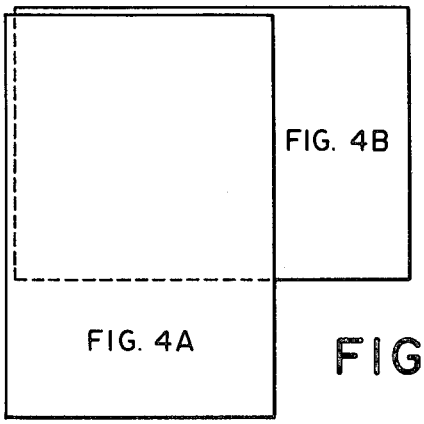
FIG. 4 illustrates an relationship of FIGS. 4A and 4B.
Figure 4A:
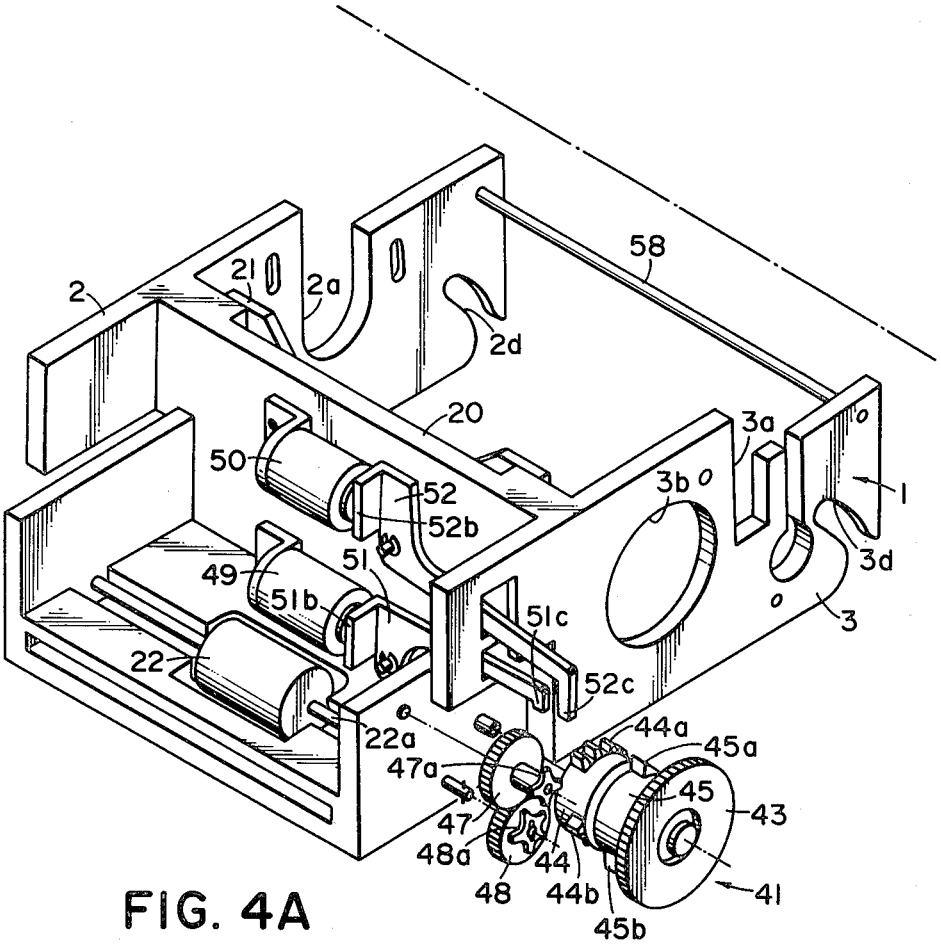
FIGS. 4A and 4B show an exploded perspective view of an embodiment of the present invention in their combination.
Figure 5:
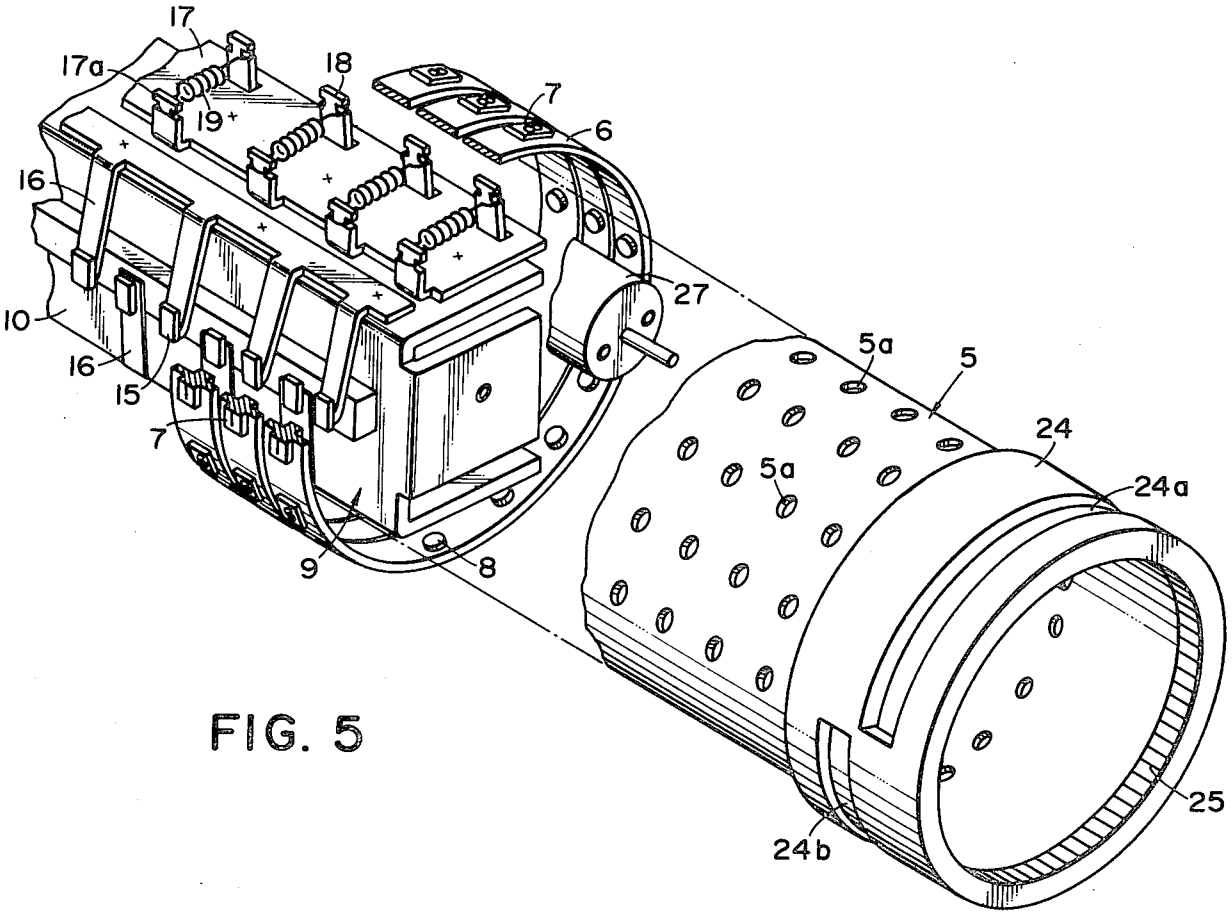
FIG. 5 is an exploded perspective view of a printing type drum.

Referring to FIG. 4A which illustrates an embodiment of the small printer according to the present invention, reference numeral 1 designates a frame. Rotatably journalled between the opposite side plates 2 and 3 of the frame 1 is a printing type drum 4. As shown in FIG. 5 this printing type drum 4 has a cylindrically formed base 5, and a plurality of small apertures 5*a* are formed in the peripheral surface of the base 5 at a predetermined pitch in radial and axial directions. Printing type belts 6 are mounted on the peripheral surface of the base 5. Each of the printing type belts 6 is annularly formed, and printing type portions 7 are projectedly provided on the outer surface thereof, while projections 8 are provided on the inner surface thereof at locations corresponding to the printing type portions 7. These projections 8 are slidably fitted in the small apertures 5*a* of the base 5. It should be noted that since the diameter of each printing type belt 6 in its free condition is smaller than the outside diameter of the base 5, the printing type belt when mounted on the base 5 his a predetermined tension. This preferably facilitates the return of the printing types.

Now, the arrangement of the printing type portions 7 of each printing type belt 6, if shown in a developed view, will be such as shown in FIG. 6, for example. As seen in FIG. 6, each printing type belt 6 has eighteen digits and there are two sets of columns corresponding to two colors, each set comprising thirteen printing type portions "0–9, .,—, ,". Further, the locations of row numbers 0 and 14 are dummy printing type portions and thus, there are twenty-eight rows for one revolution of the printing type drum.

Figure 7:
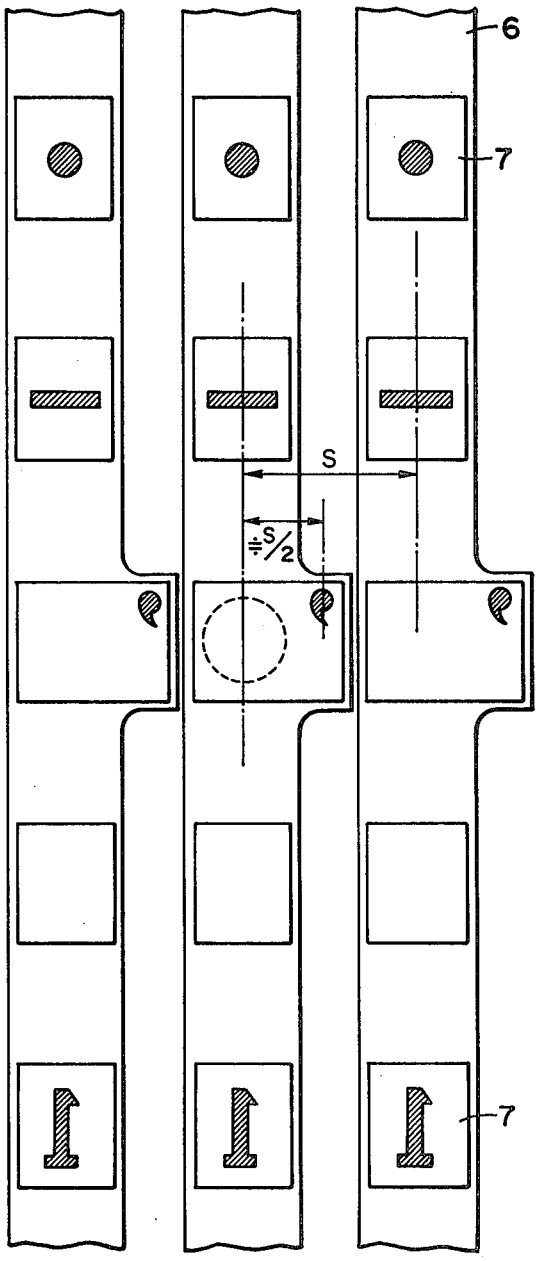
FIG. 7 is an enlarged illustration of the portion P of FIG. 6.

As shown in the enlarged view of FIG. 7, the portion "," which is one of the printing type portions of a printing type belt 6 is formed projectedly toward the adjacent printing type belt. That is, there is normally nothing present between the printing type belts wrapped around the base and therefore, there are relatively surplus space margins in these portions, by utilizing which "," is projectedly provided. The amount of projection of this "," is approximately ½S as shown in FIG. 7, S being the pitch between adjacent printing type belts. Accordingly, "," can be printed at the right shoulder portion of other printing type portion without overlapping the latter. Of course, design may also be made such that "," can be printed at the right lower portion of other printing type portion. This is for the purpose of enabling units to be printed without increasing the number of digits as in the printing format shown in FIG. 2C.

On the other hand, a hammer unit 9 is contained inside the base 5. This hammer unit 9 is assembled with a support frame 10 of substantially U-shaped cross-section as the reference and, as shown in the enlarged view of FIG. 8, coils 11, alternately arranged above and below, are fixed within the support frame 10. Each of the coils 11 has a cylindrical structure and has an iron core 12 fixedly fitted in the bobbin thereof. A guide cylinder 13 is provided correspondingly to each coil and a hammer rod 14 is slidably fitted within the guide cylinder 13, one end of the hammer rod 14 being formed with a hammer 15 corresponding to each printing type belt.

As is clear from FIG. 5, a return spring 16 corresponding to each hammer 15 and comprising a plate spring, is mounted on the upper and lower portions of the support frame 10 and on the hammer 15 side. The end portion of the return spring 16 is engaged with a groove 14*a* formed in the base of the hammer 15 of the hammer rod 14, thereby normally imparting to the hammer rod 14 a movement in the direction of retraction.

Brackets 17 are secured to the upper and lower portions of the support frame 10, and a spring 19 is extended between a projected piece 17*a* projected on each bracket 17 toward the return spring 16 and the outer end of an armature 18 fitted in a hole 17*b* formed in one end portion of each bracket. The end of the armature 18 is caused to face the vicinity of the rear end of the hammer rod 14 and the rotation thereof by the spring 19 is controlled by a stopper 13*a* integral with the guide cylinder 13. Accordingly, when power is supplied to the coil 11 to energize the iron core 12, the armature 18 is attracted and violently beats the rear end of the hammer rod 14 to advance the same, and the hammer 15 beats a projection 8 of the printing type belt 6 against the force of the return spring 16 to thereby resiliently deform the printing type belt 6 and force out the printing type portion 7, thus effecting printing on printing paper.

Figure 8:
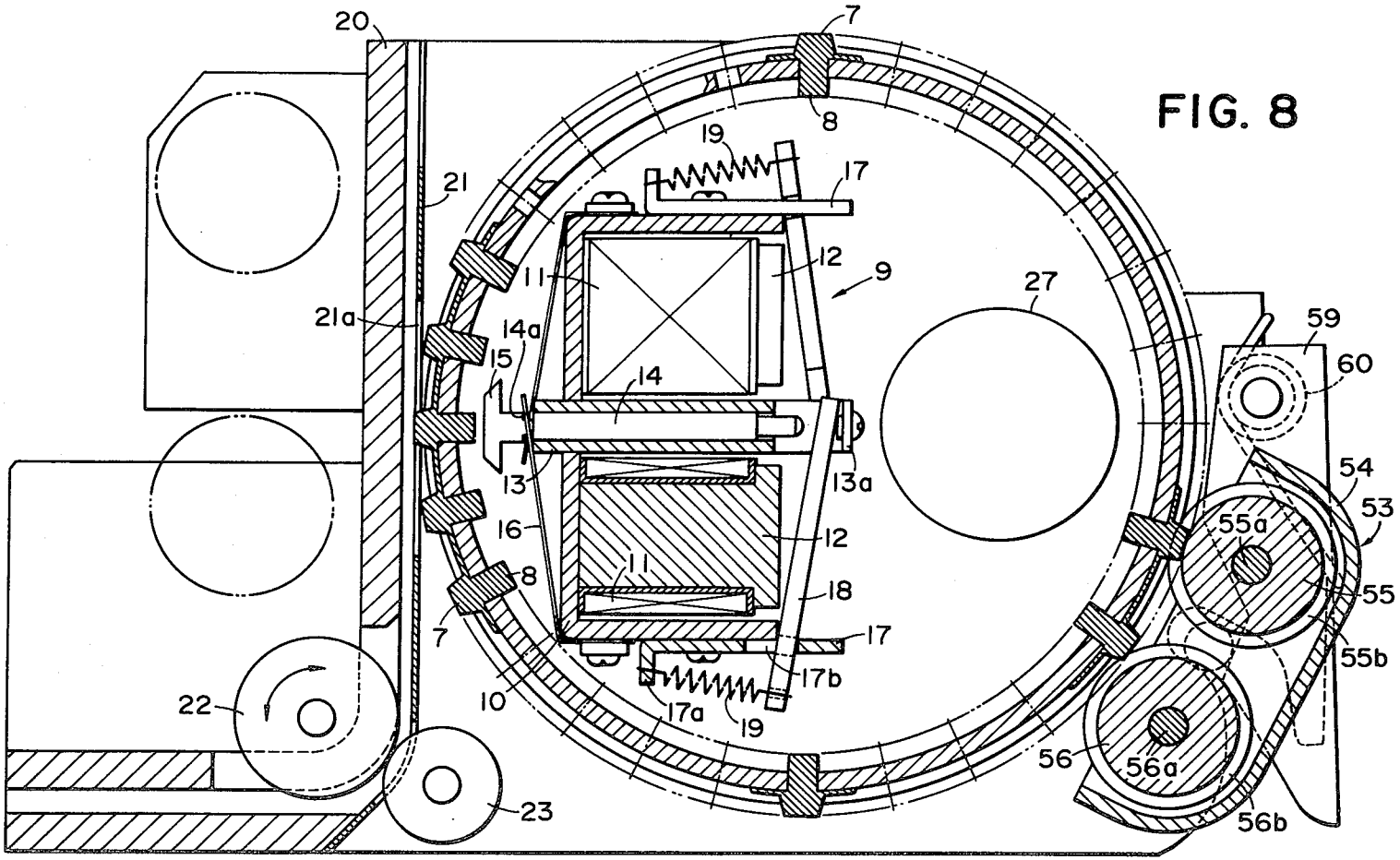
FIG. 8 is a longitudinal cross-sectional view of the printing type drum.

As shown in FIG. 8, a platen 20 is formed integral with the frame 1 and forwardly of the printing type drum 4. Paper may be guided between the platen 20 and a paper guide 21, and the printing type portion 7 may be projected through an opening 21*a* formed in the paper guide 21, thereby effecting printing on printing paper, not shown. A paper feed roller 22 is disposed below the platen 20. The printing paper is held between the paper feed roller 22 and a pinch roller 23 urged thereagainst, so that the printing paper is moved forward or backward by a method which will later be described.

On the other hand, on the opposite end portions of the base 5, thick-walled portions 24 of a predetermined width are formed integrally with the base 5. In the outer peripheral surface of each of the thick-walled portions 24, arcuate guide grooves 24*a* and 24*b*, axially offset with respect to each other, are formed. These guide grooves 24*a* and 24*b* are about 180° out of phase with each other.

In the inner peripheral surface of one of these thick-walled portions 24, for example, the right-hand thick-walled portion 24 in FIG. 4, an internal gear 25 is formed along the end edge thereof as shown in FIG. 5. A bearing member 26 (see FIG. 4) is rotatably fitted in the open end of the thick-walled portion 24 which is formed with the internal gear 25.

The bearing member 26 is shaped in the form of a relatively thick disc, and the aforementioned hammer unit 9 is fixed to the inner side surface thereof with the support frame 10 interposed therebetween, and a motor 27 is fixed in juxtaposed relationship with the hammer unit. A rectangular boss 26*a* is projectedly provided on the outer side surface of the bearing member 26, is fitted in a rectangular cut-away 3*a* formed in one side plate 3, and is secured to the side plate 3 by means of screws or the like.

Arcuate cut-aways 26*b* and 26*c* are formed in the outer side surface of the bearing member 26 with the boss 26*a* interposed therebetween. A support shaft 28 is projected from the central portion of one cut-away 26*b* and an intermediate gear 29 is rotatably fitted on the support shaft 28. The intermediate gear 29 has a small-diameter gear 29*a* and a large-diameter gear 29*b*. The small-diameter gear 29*a* faces outwardly from the opening end of the cut-away 26*b* and meshes with the internal gear 25 of the aforementioned thick-walled portion 24.

A support shaft 30 is projected from the other cut-away 26*c* and an intermediate gear 31 is rotatably fitted on this support shaft 30. The intermediate gear 31 has a small-diameter gear 31*a* and a large-diameter gear 31*b*, and the small-diameter gear 31*a* faces outwardly from the opening end of the cut-away 26*c* and meshes with the aforementioned internal gear 25. The large-diameter gear 31*b* meshes with a pinion gear 32 secured to the rotary shaft 27*a* of the motor 27, to transmit the rotation of the motor 27 to the small-diameter gear 31*a* and rotate the printing type drum through the agency of the internal gear 25 and further rotate the intermediate gear 29 through the agency of the internal gear 25.

The bearing member 26 is positioned by the boss 26*a* and supports the base 5 by the two small-diameter gears 29*a* and 31*a* through the internal gear 25 and therefore, the base 5 is rotatable relative to the bearing member 26.

The intermediate gear 29 is rotatably fitted in a circular opening 3*b* formed in the side plate 3.

Figure 4B:
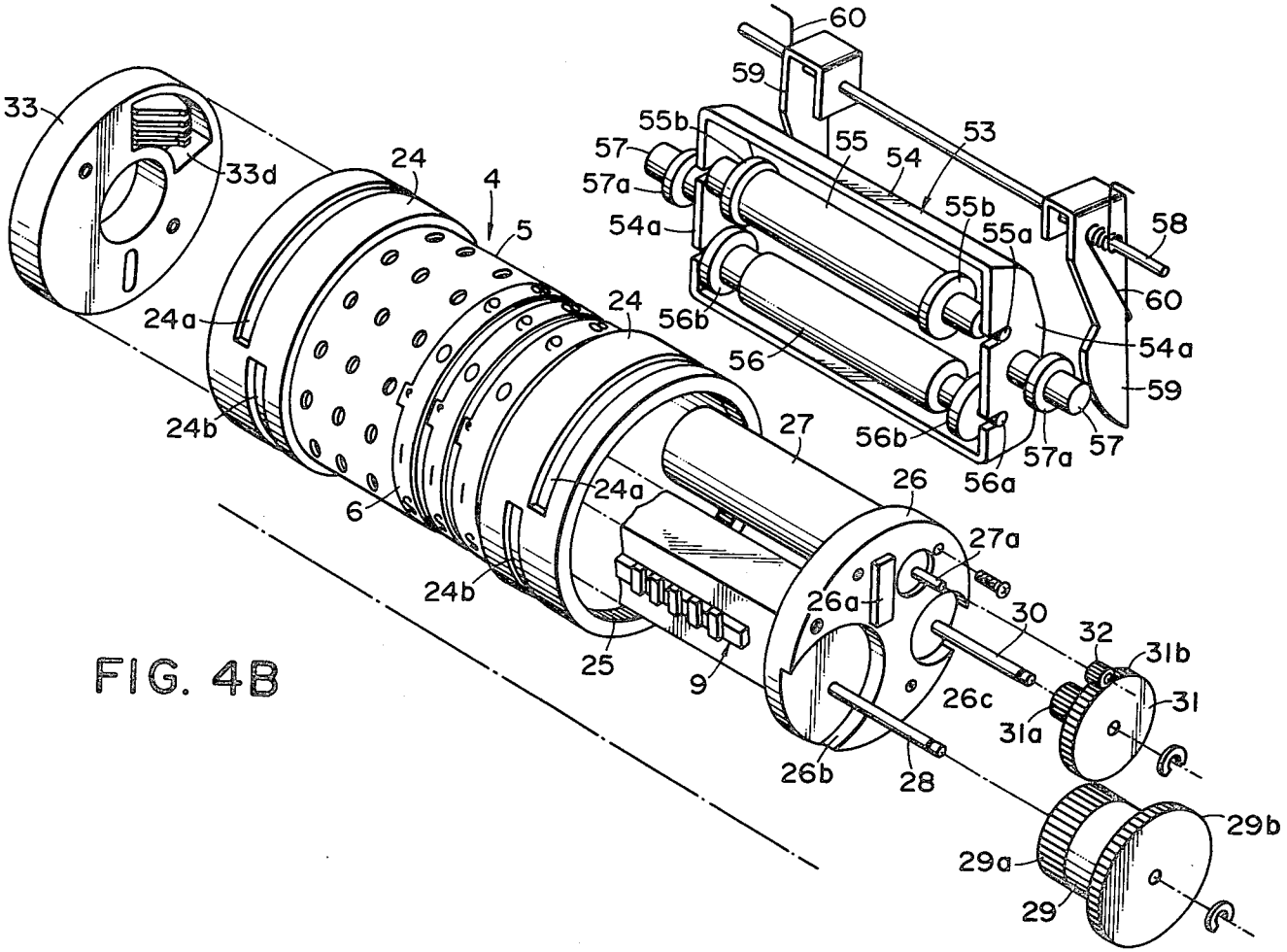

On the other hand, in FIG. 4*b*, the thick-walled portion 24 side formed at the left of the base 5 is rotatably journalled by another bearing member 33. Inside this left-hand thick-walled portion 24, a code plate 34 spaced apart a predetermined distance from the opening end is secured by screws 34*a*. This code plate 34 has an annular conductive pattern 35, outside of which contacts 35*a* corresponding to the printing type portions of the odd-number placed of each printing type belt are formed and inside of which contacts 35*b* corresponding to the printing type portions of the evennumber placed of each printing type belt are formed and a contact 35*c* for detecting the home position of the printing type drum is further formed. In the center of the code plate 34, there is formed a through-hole 34*b* into which a lead wire or the like for supplying power to the hammer unit 9 is directed and into which one end of the support frame 10 of the hammer unit 9 is directed.

Figure 9:
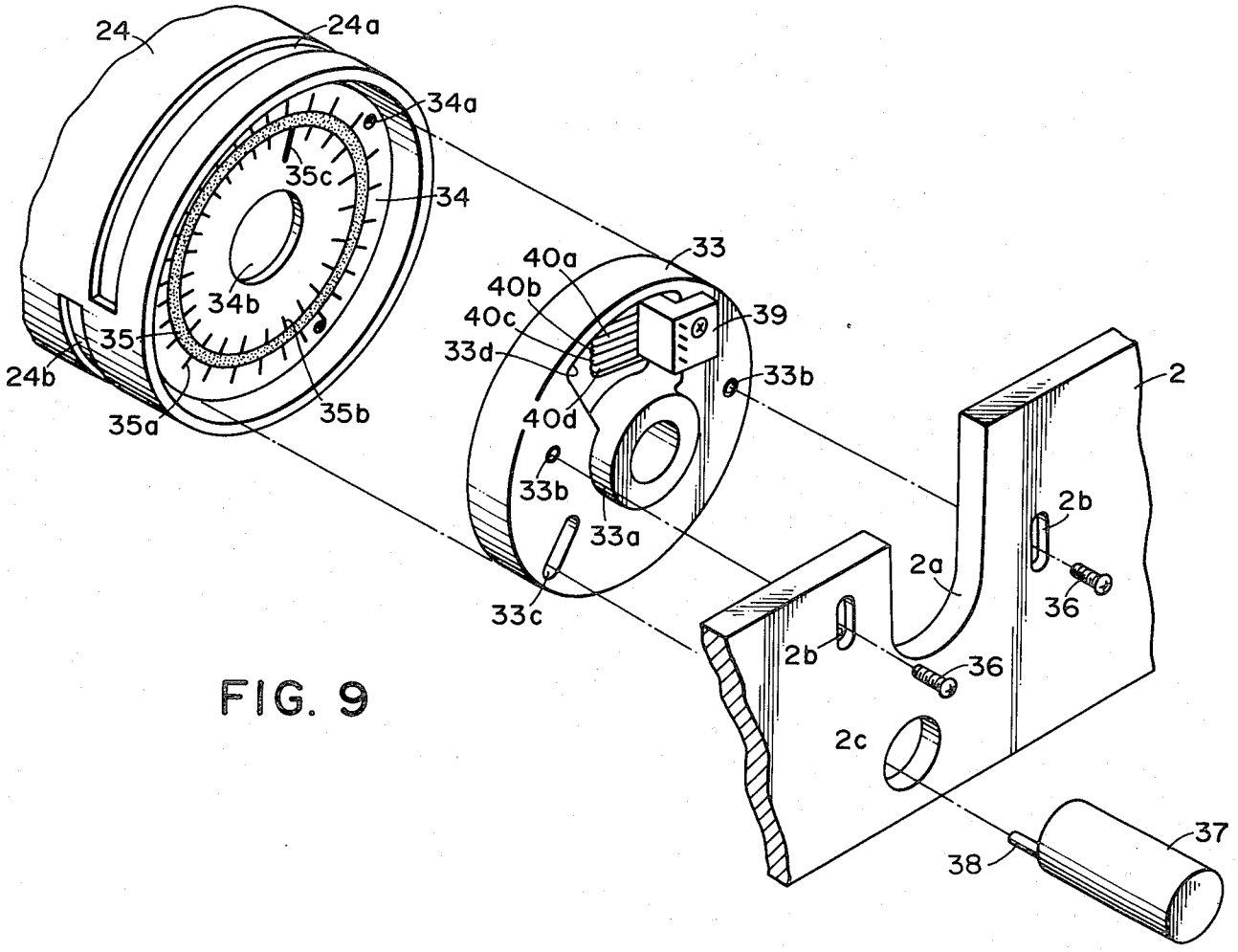
FIG. 9 is a perspective view illustrating the mounting structures of a code plate and a timing adjusting pin.

The bearing member 33 has a cylindrically-shaped boss 33*a* formed on the outer peripheral surface thereof as shown in the enlarged view of FIG. 9, the boss 33*a* being fitted to the lower portion of a substantially U-shaped cut-away 2*a* formed in one side plate 2. Arcuately-shaped slots 2*b* and 2*b* are formed in the side plate 2 on the opposite sides of the cutaway 2*a*, and the bearing member 33 may be fixed by causing screws 36 fitted in these slots 2*b* to be fitted in threaded holes 33*b* formed in the outer side surface of the bearing member 33, but the mounted position of the bearing member 33 is adjustable within the range of the slots 2*b*.

Formed in the side plate 2 adjacent to the cut-away 2*a* is a through-hole 2*c* in which a timing signal adjusting pin 37 is rotatably fitted. An eccentric pin 38 is projectedly provided on the end of the adjusting pin 37 and is fitted in a slot 33*c* formed in the bearing member 33 radially thereof. Accordingly, rotation of the adjusting pin 37 causes rotation of the eccentric pin 38 with a result that the bearing member 33 is rotated to enable the mounted position thereof to be finely adjusted and, after the fine adjustment has been terminated, the bearing member 33 may be rigidly fixed by means of the aforementioned screws 36.

An opening 33*d* is formed in the bearing member 33 at an eccentric location thereof and a fitting metal 39 is fixed to the edge of the opening, and four contact pieces 40*a*–40*d* have one end thereof secured to the fitting metal 39. The uppermost contact piece 40*a* as viewed in FIG. 9 is at a position in which it can contact a contact 35*a* corresponding to the printing type portion of the odd number place of the conductive pattern 35, the second contact piece 40*b* is normally in contact with the annular portion of the conductive pattern, the third contact piece 40*c* is at a position in which it can contact a contact 35*b* corresponding to the printing type portion of the printing type belt of the even number place, and the lowermost contact piece 40*d* faces a position in which it can contact a home position detecting contact 35*c*.

By the cooperation between these contact pieces 40*a*–40*d* and the conductive pattern 35, there can be provided a timing signal which will later be described.

On the other hand, a spring clutch 41 is attached to a portion of the side plate 3. The spring clutch 41 has a drive gear 43 rotatably fitted on one end of a rotary shaft 42 fixed to the side plate 3, the drive gear 43 being in mesh engagement with the large-diameter gear 29*b* of the aforementioned intermediate gear 29. A partly untoothed gear 44 is rotatably fitted on the shaft portion 43*a* of the drive gear 43 and the rotary shaft 42. A ratchet wheel 45 is rotatably fitted to the outer side of the partly untoothed gear 44. An input end 46*a* which is one end of a coil spring 46 wound around the shaft portion 43*a* of the drive gear 43 is engaged with an engagement portion 45*a* formed on a portion of the ratchet wheel 45, and an output end 46*b* which is the other end of the coil spring 46 is engaged with an engagement portion 44*a* formed on a portion of the partly untoothed gear 44. Accordingly, when the drive gear 43 is rotated in the direction in which the coil spring 46 is wound, the spring clutch 41 will be rotated therewith.

Figure 13:
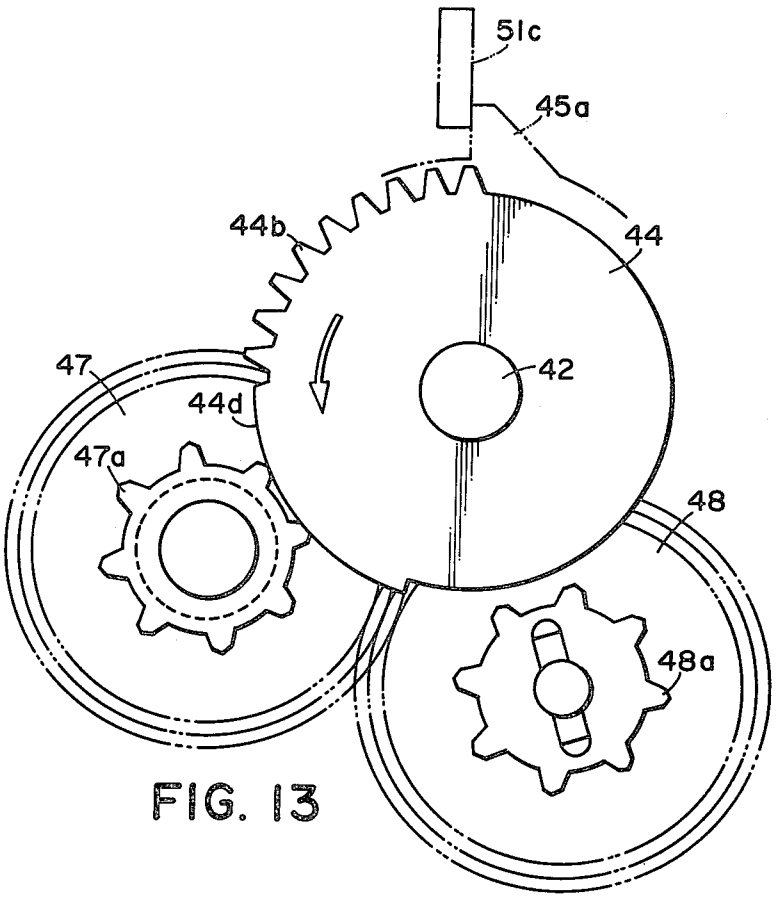
FIGS. 12 and 13 are side views illustrating the operative association between a partly untoothed gear and advance and return gears.
Figure 12:
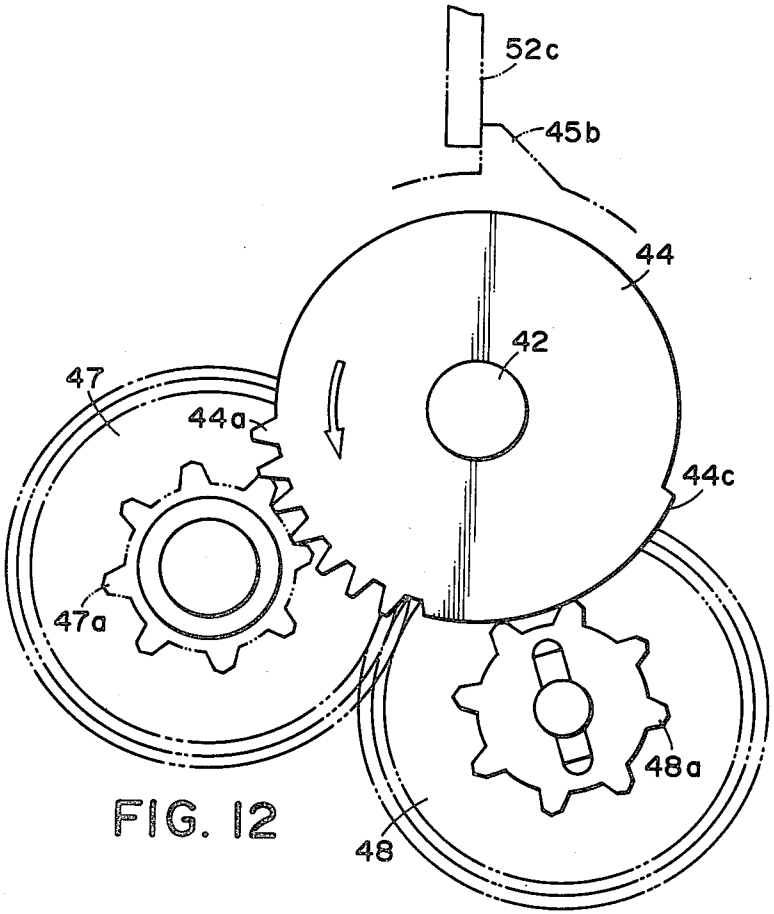

Toothed portions 44*a* and 44*b* are formed over predetermined angle ranges on the outer peripheral surface of the partly untoothed gear 44, the toothed portions 44*a*, 44*b* being offset axially of the gear 44 and also being out of phase with each other circumferentially of the gear 44, and cam portions 44*c* and 44*d* are formed contiguously to these toothed portions 44*a* and 44*b*, respectively, as shown in FIGS. 12 and 13.

Figure 10:
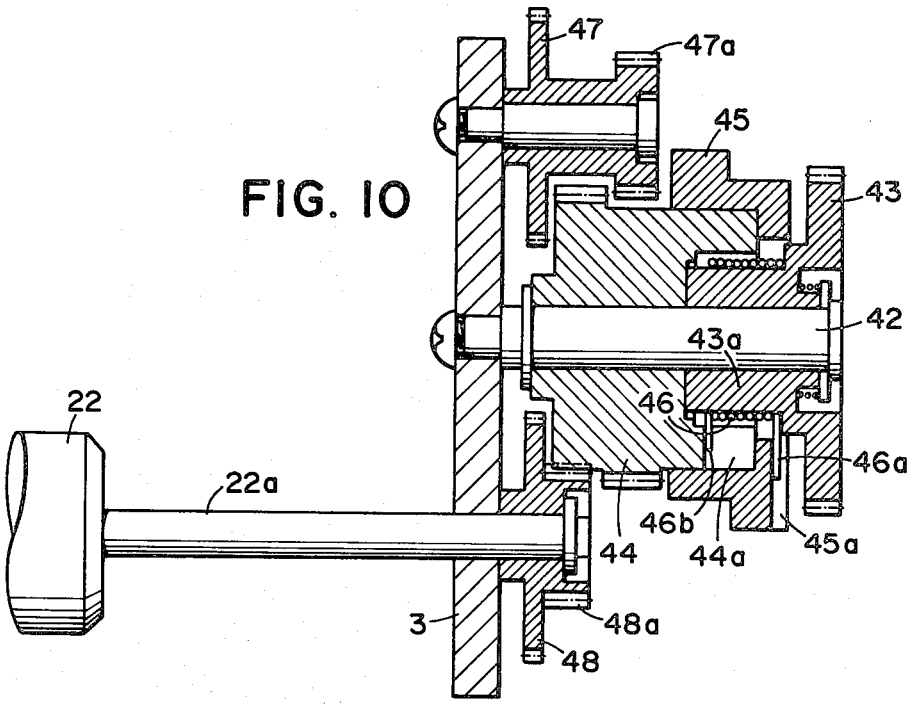
FIG. 10 is a cross-sectional view illustrating the structure of a spring clutch.

An advance gear 47 and a return gear 48 are rotatably journalled to the side plate 3 adjacent to the partly untoothed gear 44, the gears 47 and 48 being in mesh engagement with each other. (FIG. 10 is a developed cross-sectional view.).

An untoothed portion 48*a* formed integrally with one side surface of the return gear 48 is in mesh engagement with the toothed portion 44*a* of the partly untoothed gear 44 which is adjacent to the side plate 3, and an untoothed portion 47*a* formed integrally with one side surface of the advance gear 47 is in mesh engagement with the toothed portion 44*b* of the partly untoothed gear 44 which is adjacent to the ratchet wheel 45.

Ratchets 45*a* and 45*b* are formed on the peripheral surface of the ratchet wheel 45, the ratchets 45*a* and 45*b* being about 180° out of phase with each other and being offset from each other axially of the ratchet wheel. The shaft of the return gear 48*a* is integral with the rotary shaft 22*a* of the paper feed roller 22.

Figure 11:
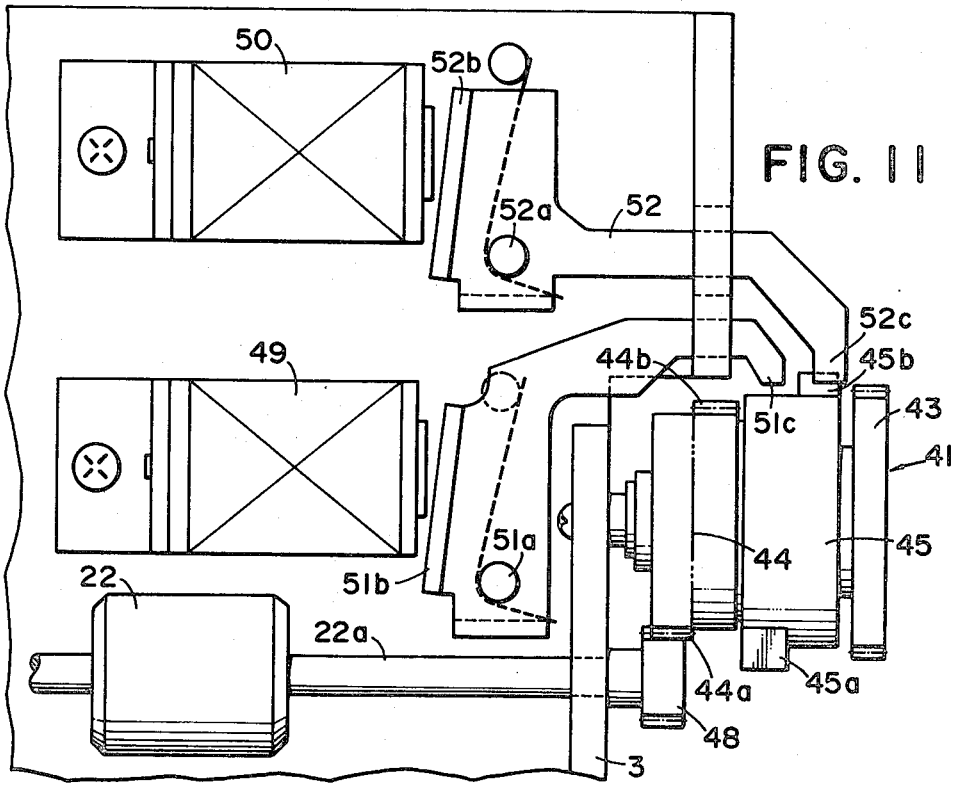
FIG. 11 is a side view illustrating the operative association between the spring clutch and advance and return solenoids.

On the other hand, an advance solenoid 49 and a return solenoid 50 are mounted parallel to each other by utilization of one side surface of the platen 20. In opposed relationship with the cores of the solenoids 49 and 50, substantially L-shaped levers 51 and 52 also serving as armatures are pivotably supported on said one side surface of the platen 20 by means of pins. One end of each of these levers 51, 52 faces the core of the solenoid 49, 50, and the other ends of the levers 51, 52 face the positions in which they can engage the ratchets 45*a*, 45*b* of the ratchet wheel 45, as seen in FIG. 11. The supported points of the levers 51 and 52 are pins 51*a* and 52*a*, respectively, and the flat surfaces thereof are 51*b* and 52*b*.

These solenoids 49 and 50 are supplied with power at a timing which will later be described, and the ends 51*c* and 52*c* of the levers 51 and 52 alternately engage the ratchets 45*a* and 45*b* of the ratchet wheel 45 to move printing paper forwardly and backwardly.

On the other hand, an ink roller unit 53 is disposed on that side of the printing type drum 4 which is opposite to the platen 20. The ink roller unit 53 has a flat housing 54 in which a pair of ink rollers 55 and 56 are contained, and the rotary shafts 55*a* and 55*b* of the respective ink rollers are rotatably journalled to the opposite side plates 54*a* and 54*a* of the housing 54. The upper one of these ink rollers, 55, is for applying violet ink, for example, and the lower ink roller 56 is for applying red ink. Flanges 55*b* and 56*b* are integrally formed on the opposite ends of these ink rollers 55 and 56. The flanges 55*b*, 55*b* of the ink roller 55 are positioned so as to fit in inner grooves 24*b*, 24*b* formed in the thick-walled portions at the opposite ends of the aforementioned base 5, and the flanges 56*b*, 56*b* of the ink roller 56 are positioned so as to fit in outer grooves 24*a*, 24*a* formed in the thick-walled portions 24.

A pair of support shafts 57, 57 projected from the opposite side plates 54*a* of the housing 54 of the ink roller unit 53 having the above-described construction are fitted in cut-away portions 2*d*, 3*d* formed in the rear end portions of the side plates 2, 3 and extending from the lower portion toward the upper portion. To prevent axial positional deviation of the housing 54, flanges 57*a*, 57*a* formed on the support shafts 57 intermediately thereof are positioned outwardly of the side plates 2, 3.

A support shaft 58 extends between and through the upper portions of the rear ends of the side plates 2 and 3, and pivotable levers 59 and 59 are pivotably mounted on the opposite ends of the support shaft 58 and biased for rotation toward said support shafts 57 by torsion coil springs 60 wound on the support shaft 58 so as to urge the housing 54 and accordingly the ink rollers 55, 56 against the printing type belts of the printing type drum 4.

The operation of the present embodiment constructed as described above will now be described with reference to the timing chart of FIG. 14.

First, when a print instruction comes, the motor 27 starts rotating and this rotation is transmitted through the pinion gear 32 to the large-diameter gear 31*b* and small-diameter gear 31*a* of the intermediate gear 31, so that the printing type drum 4 is rotated through the intermediary of the internal gear 25 of the base 5. When the contact 35*c* for detecting the home position of the conductive pattern 35 of the code plate 34 comes into contact with the contact piece 40*d* as the printing type drum 4 is rotated, there is generated TR signal which is a signal informing of the home position per full rotation of the printing type drum 4.

Simultaneously therewith, the contact pieces 40*a*, 40*c* and 40*b* come into contact with the contacts 35*a* and 35*b* of the conductive pattern, whereupon timing signals TP-S of odd number rows and timing signals TP-R of even number rows are generated out of phase with each other. These signals are inputted to the flip-flop circuit of a control circuit, not shown, and are waveform in shape with shuttering produced because of the mechanical contact. The mechanical contact comprises a contact piece and a contact. Also, these timing signals TP-S and TP-R cause a signal to be generated between each adjacent pair of type portions and shorten the time during which power is supplied to the coil of the hammer, thereby saving the electric power. As a result, there are generated 56 timing signals per full rotation of the printing type drum 4, which number is twice the 28 kinds of printing type portions as previously mentioned. These timing signals TP-S and TP-R are counted by the counter of the control circuit, and the coincidence thereof with the home position detecting TR signal is taken, whereupon printing is started for odd number rows and even number rows, respectively.

Description will now be made of a case where "123'000" is printed in violet.

Figure 14:
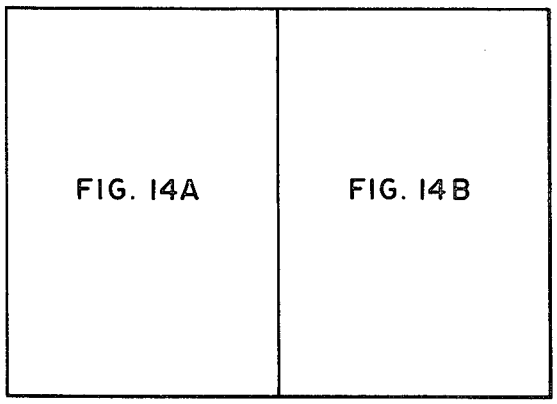
FIG. 14 illustrates a connecting relationship of FIGS. 14A and 14B.

First, as shown in FIG. 14, when print instruction signal is generated, the motor 27 is powered and rotated. By the rotation of this motor 27, the drive gear 43 of the spring clutch 41 is rotated through the intermediary of the large-diameter gear 29*b* of the intermediate gear 29. Thereupon, due to the friction force of the coil spring 46 wound around the shaft portion 43*a* of the drive gear 43, the rotational force is transmitted to the partly untoothed gear 44 through the output end 46*b*.

After the print instruction signal has been generated, power is supplied to the return solenoid 50 from a control circuit, not shown (see FIG. 14), whereby the return lever 52 is attracted to the adsorption surface 52*b* and pivoted counterclockwisely about the pin 52*a* as viewed in FIG. 11, so that the end 52*c* of the return lever 52 is disengaged from the ratchet 46*b* of the ratchet wheel 45. As a result, the partly untoothed gear 44 is rotated through the intermediary of the coil spring 46 and as shown in FIG. 12, the cam portion 44*c* contiguous to the toothed portion 44*a* of the partly untoothed gear 44 passes while keeping contact with the untoothed portion 48*a* of the return gear 48 (at this time, the cam portion 44*d* contiguous to another toothed portion 44*b* is not yet in contact with the untoothed portion 47*a* of the advance gear 47) and accordingly, the gears 47 and 48 are not rotated at all. However, the toothed portion 44*a* soon begins to mesh with the untoothed portion 48*a* and the return gear 48 is rotated through about 180° to rotate the paper feed roller 22 through about 180° and returning the printing paper by about 20 mm, thus providing a printing position. In the meantime, the advance gear 47 idly rotates through about 180°. The gear ratio between the gear 47 and the gear 48 is 1:1.

Printing is started in this condition. The printing color is violet at first and therefore, the section between TP0 to TP25 is a violet section and so, when TP0 has been generated, power is supplied to the coil 11 corresponding to each place of the hammer unit 9, thus printing "1" at first. Next, type "2" is printed by timing signal TP2, and then type "3" is printed by timing signal TP4, and in this manner, printing is progressed and finally, type "," is printed by TP24 only at the place whereat type "3" has been printed, thus completing a line of printing.

When a line of printing has been completed, power is supplied to the advance solenoid 49 by the signal from a control circuit, not shown, whereby the adsorption surface **51*b* of the advance lever 51 is attracted. The advance lever 51 is pivoted counter-clockwise about the shaft 51*a* as viewed in FIG. 11, so that the end 51*c* of the advance lever is disengaged from the ratchet 45*a* of the ratchet wheel 45. At this time, as is clear from the timing chart of FIG. 14, the power supply to the return solenoid 50 is terminated and the aforementioned return lever 52 returns to its original condition in which the end 52*c* thereof faces a position in which it can engage the ratchet 45*b* of the ratchet wheel 45**.

Figure 3A:
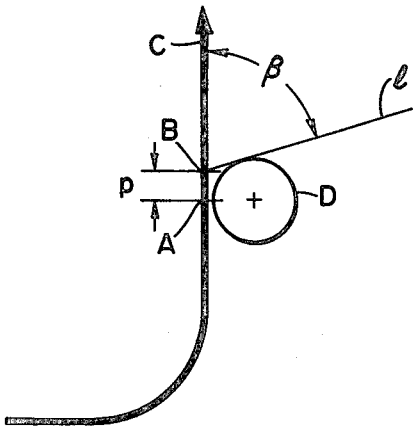
FIG. 3A PRIOR ART
FIGS. 3A and 3B illustrate prior art systems for securing a great visibility angle.
Figure 3B:
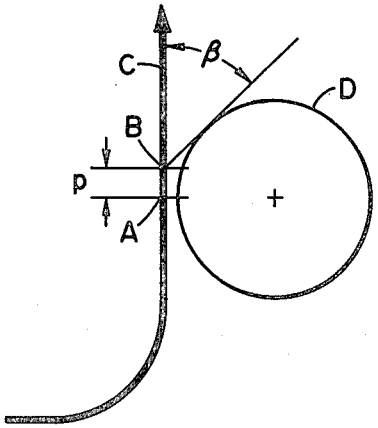
FIG. 3B PRIOR ART
Figure 3C:
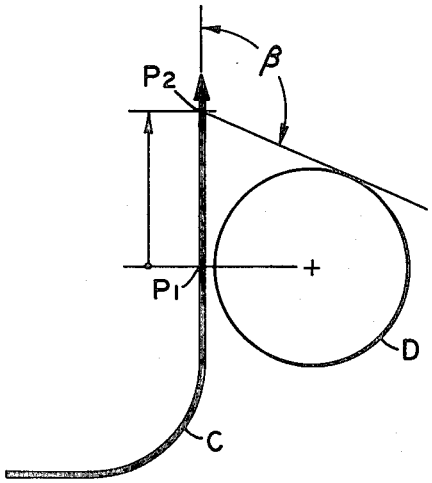
FIGS. 3C and 3D illustrate a system for increasing the visibility angle which is applied to the present invention.
Figure 3D:
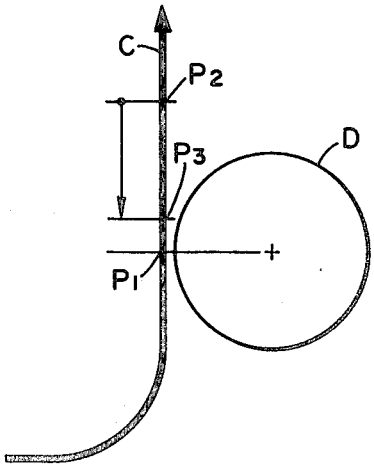

In this condition, the input end **46*a* of the coil spring 46 becomes free and the friction force between the shaft portion 43*a* of the drive gear 43 and the coil spring 46 increases, so that the rotation of the drive gear 43 is transmitted to the partly untoothed gear 44. When the partly untoothed gear 44 begins to rotate, as shown in FIG. 13, the cam portion 44*d* contiguous to the toothed portion 44*b* comes into contact with the untoothed portion 47*a* of the advance gear 47, and soon the toothed portion 44*b* begins to mesh with the untoothed portion 47*a*, but in the meantime, the gears 47 and 48 are not rotated. When the toothed portion 44*b* begins to mesh with the untoothed portion 47*a*, the advance gear 47 is rotated through 225° while meshing with the return gear 48, to thereby rotate the return gear 48 through 225° in the direction opposite to that during said return of paper and rotate the paper feed roller 22 through 225° in the same direction, thus advancing the printing paper by 25 mm. As a result, the visibility angle $\beta$ can be remarkably increased as shown in FIGS. 3C and 3D** and also, the consumption amount of the printing paper can be made as small as 25 mm−20 mm=5 mm.

An example in which "123'000.−" is printed in violet has been described above, and a control method used when this is printed in red will now be described.

When printing is to be started, power is supplied to the return solenoid 50 in the same manner as described with respect to the violet printing, to thereby bring back the printing paper.

This time the substance to be printed is red and therefore, as is apparent from the lower half portion of the timing chart of FIG. 14, TP signals 28–53, after TR signal has been generated, are in the red type range. Thus, the motor 27 is rotated to step-advance the printing type drum 4 until TP28 is generated. When timing signal TP28 has been generated, power is supplied to the coil 11 of the hammer unit 9 through a control circuit, not shown, to thereby print type "1" at a predetermined place. Thereafter, printing is progressed, whereby type "," is printed in synchronism with timing pulse TP52 to complete a line of red printing operation. Whereafter power is supplied to the advance solenoid 49 in the same manner as previously described and the printing paper is advanced by 25 mm so that the printed result can be seen well. The paper feeding operation is terminated, whereupon the power supply to the motor is cut off, thus completing the printing in red.

The method of control for printing in violet and red and the drive mechanism portion have been described above. The operation of the ink roller unit 53 in this case will now be described.

Figure 15:
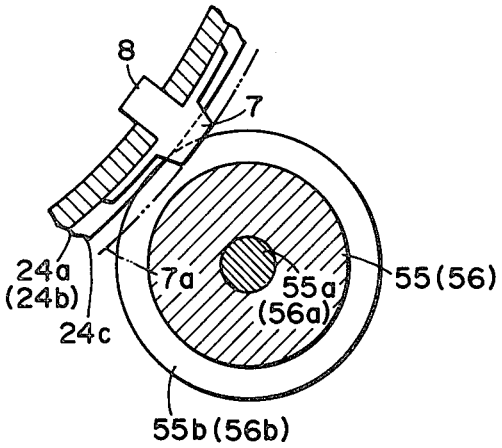
FIGS. 15–18 illustrate the contact condition between ink rollers and the printing type drum.

The housing 54 of the ink roller unit 53 is urged against the printing type belts 6 of the printing type drum 4 by the pair of pivotable levers 59. The flanges **55*b* and 56*b* formed on the opposite ends of the ink roller 55 for violet and the ink roller 56 for red are in a positional relationship in which they can fit in guide grooves 24*b* and 24*a*. The slide grooves are formed out of phase with each other in the peripheral surfaces of the thick-walled portions 24 which portions are formed on the opposite ends of the base 5. As can be seen in FIG. 4, there is a non-continuous portion between the ends of the two guide grooves 24*a* and 24*b* and therefore, when the flanges 55*b* and 56*b* are in direct contact with this non-continuous portion, namely, the outer peripheral surface of the thick-walled portion 24, the ink rollers cannot contact the printing type portions 7 of the printing type belts 6 because the diameter of the flanges 55*b*, 56*b* is greater than the diameter of the ink rollers 55, 56. This condition is shown in FIG. 15. In FIG. 15, reference character 24*c* designated the outer peripheral surface of the thick-walled portion 24 and reference character 7*a* denotes the locus of the printing type portion 7**.

Figure 16:
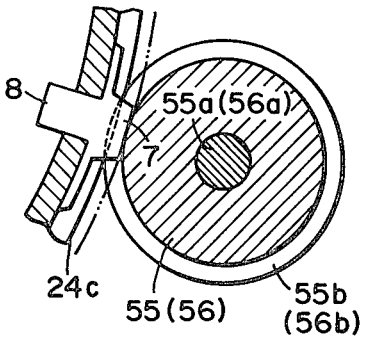
Figure 14A:
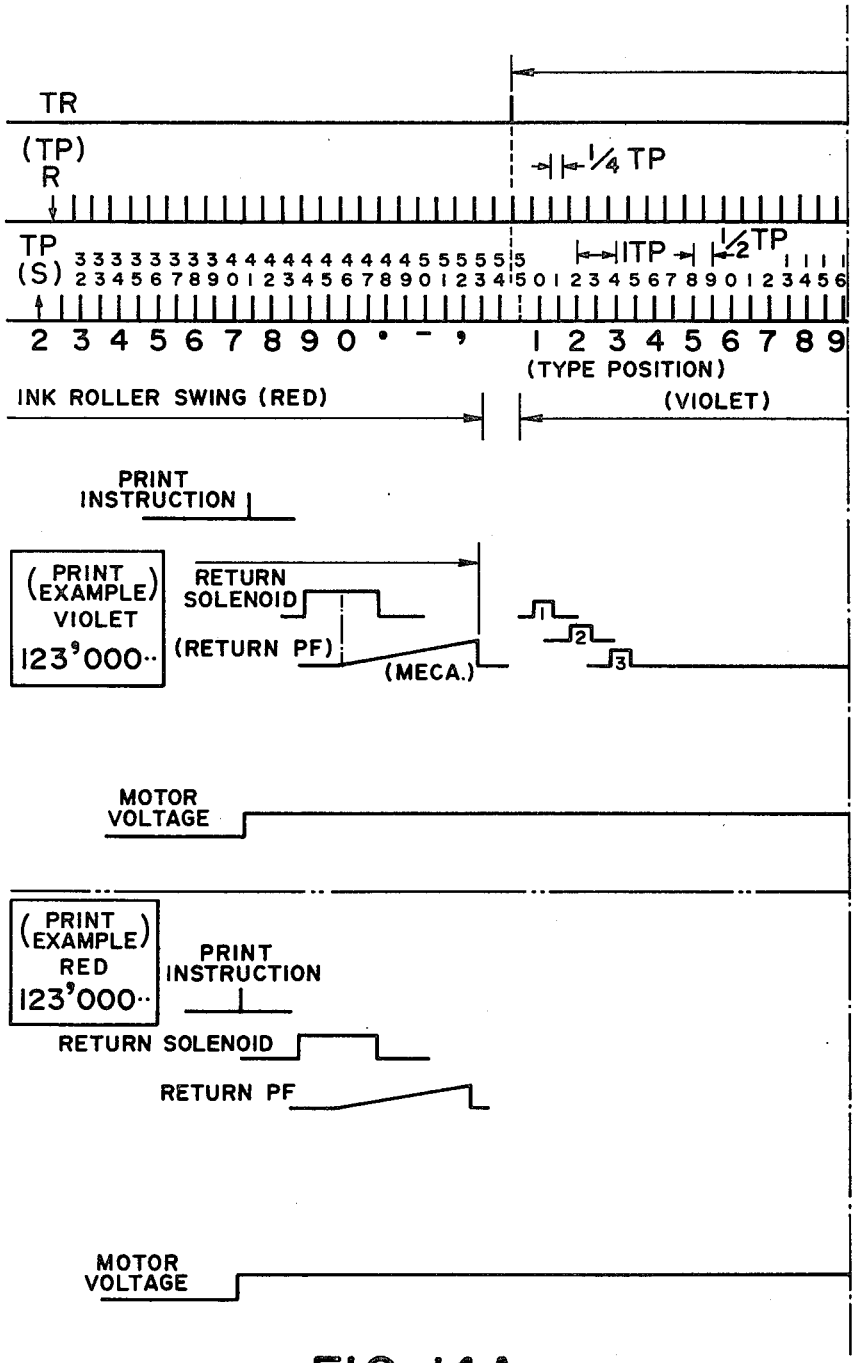
FIGS. 14A and 14B show a timing chart illustrating the printing control method in their combination.
Figure 14B:
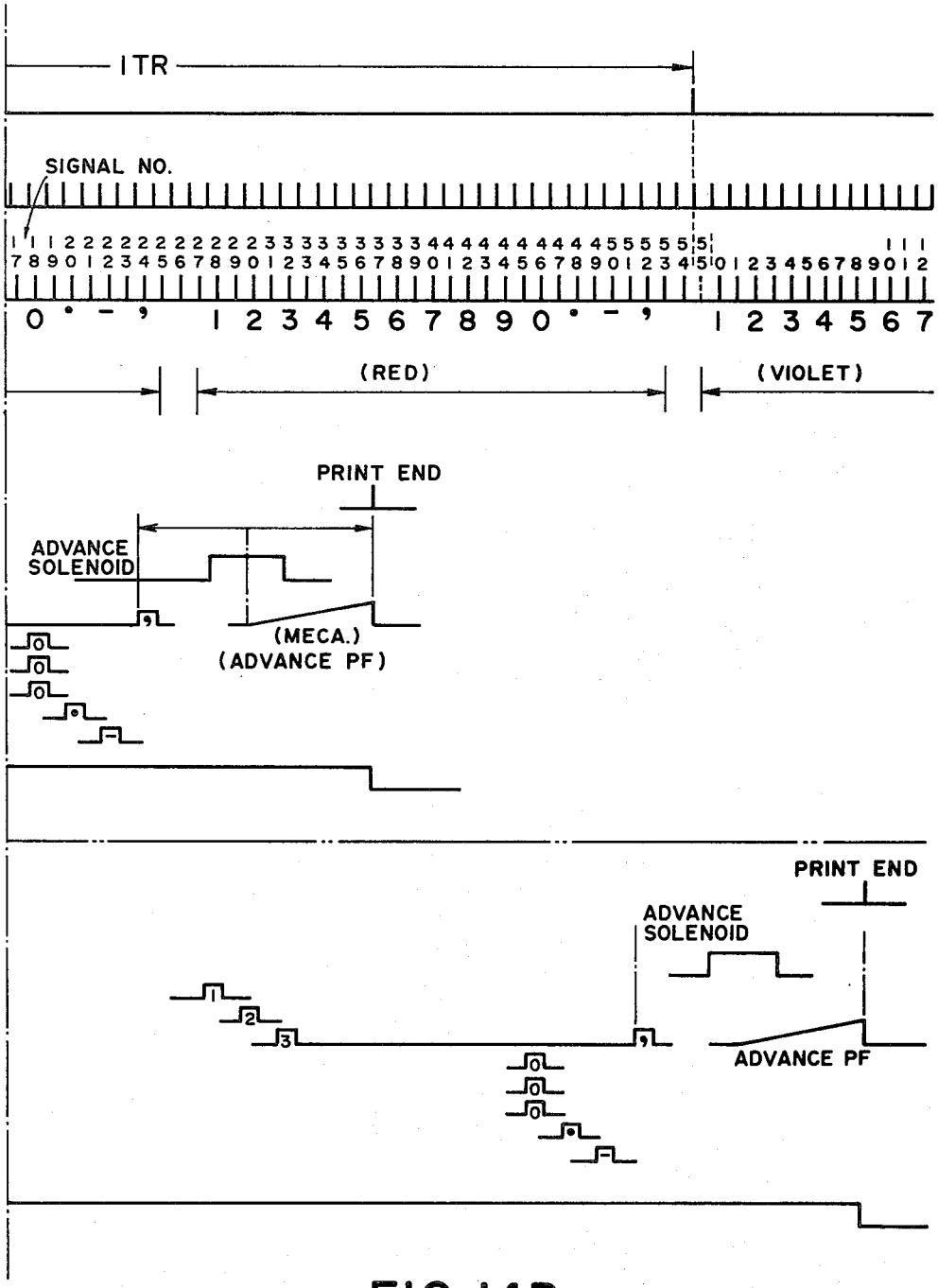

When the rotation of the printing type drum 4 progresses and the flanges **55*b*, 55*b* of the ink roller 55 or 56 fits in the guide grooves 24*a* or 24*b*, as shown in FIG. 16, the ink rollers 55, 56 come near the printing type belts 6 and the peripheral surfaces of the ink rollers are in contact with the surface of the printing type portions 7. In order that such contact between the ink rollers 55, 56 and the printing type portions 7 may be realized, it is necessary that the distance from the bottom of the guide grooves 24*a*, 24*c* to the surface of the printing type portion 7 be greater than the difference between the diameter of the flanges 55*b*, 56*b* and the diameter of the ink rollers 55, 56**.

On the other hand, the guide grooves **24*a* and 24*b* are provided so as to be 180° out of phase with each other and therefore, if the range in which one guide groove 24*a* is formed is made to correspond to the printing type groups of the printing belts 6 which are to print red and arrangement is made such that the flange 56*b* of the ink roller 56 for red fits in this groove 24*a***, then red ink can always be applied to these printing type groups.

Of course, the other guide groove **24*b* corresponds to the blue printing type groups of the printing type belts 6 and the flange 55*b* of the ink roller 55 is fitted in this guide groove 24*b***.

In FIG. 6, violet printing type groups are shown as No. 1 character group, and red printing type groups are as shown as No. 2 character group.

Figure 17:
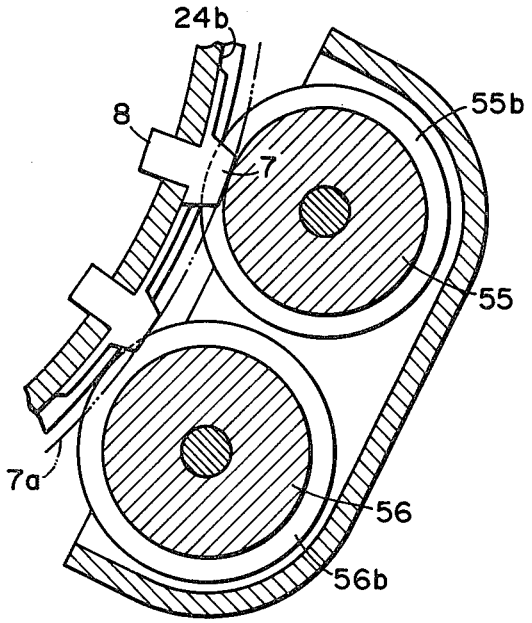

FIG. 17 shows a position in which the flange **55*b* of the ink roller 55 for violet is fitted in the guide groove 24*b* and the ink roller 55 is in contact with the printing type portion 7. In this position, when the printing type drum 4 is rotated, the ink roller 55 is rotated by the friction force between the printing type portion 7 and the ink roller 55**, whereby violet ink is applied to the violet printing type groups.

At this time, the flanges 56*b* of the ink roller 56 for red are not fitted in the guide grooves 24*a* but are in contact with the outer peripheral surface of the thick-walled portions 24 and therefore, the ink roller 56 is not in contact with the violet printing type groups.

However, the ink roller 56 is only rotated by the friction force between the outer peripheral surface of the thick-walled portions 24 and the flanges 56*b*.

Figure 18:
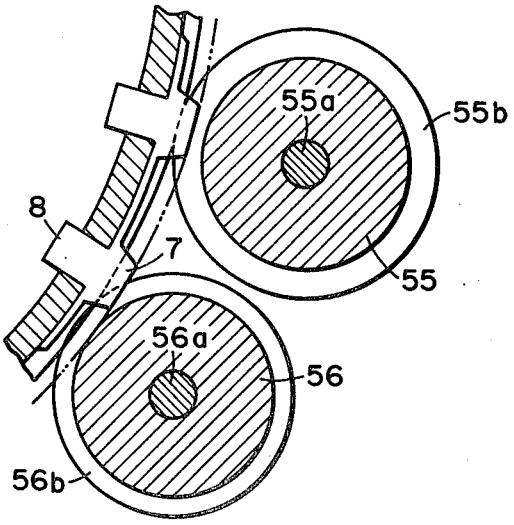

When the revolution of the printing type drum progresses from the position of FIG. 17 and the flanges 56*b* of the ink roller 56 begin to fit in the guide grooves 24*a*, the flanges 55*b* of the other ink roller 55 come out of the guide grooves 24*b* and ride onto the outer peripheral surface of the thick-walled portions 24. As a result, the ink roller 56 can apply red ink to the printing type portions 7 while the violet ink roller 55 cannot apply ink to the red printing type groups. This condition is shown in FIG. 18.

According to the present invention, as will be apparent from the foregoing description, there are obtained the following excellent effects.

(1) The adoption of a construction in which two printing type belts of the same pattern to which inks of different colors are applied are provided circumferentially of the printing type drum and ink rollers of corresponding colors can be urged against the respective printing type groups, formed on the base of the printing type drum, by the engagement between guide grooves corresponding to the respective printing type groups and different in phase and the flanges of the ink rollers leads to the possibility of printing in two distinct colors being accomplished by a very simple construction, the great ease with which the results of information printing are discriminated, and the compactness of the apparatus.

(2) Drive control is effected without the use of an expensive pulse motor but with timing signals corresponding to the printing type groups to odd number places and even number places being provided by the input contact of the conductive pattern formed on a code plate and this leads to the provision of a small printer which is inexpensive and accurate in operation.

(3) The printing type belt of each place has a unit mark "," and therefore, a printing format can be provided in which clear unit indications are effected without decreasing the number of places within a limited number of places.

(4) The adoption of a construction in which printing paper is advanced at a great pitch immediately after termination of printing and the printing paper is returned to the printing position immediately before the next printing can increase the visibility angle remarkably and also can reduce the consumption amount of printing paper.

(5) The mounted position of the printing type drum can be finely adjusted by a timing adjusting pin with great ease and any irregularities of parts resulting from machining errors of the components of the printing type drum and eccentricity of parts can be simply adjusted, thus increasing the degree of freedom of machining accuracy.

What I claim is:

1. A printing drum, comprising:

a cylindrical shaped drum; and at least two printing type belts mounted around the peripheral surface of said drum and being spaced apart by a predetermined distance, each type belt having a plurality of selectively usable type portions each with a character thereon, each type belt also having a projection which is integrally formed thereon and extends in an axial direction of said drum, wherein the projection of one of said type belts extends into the space between said belts, and wherein the character on the one type portion is provided on said projection.

2. The printing drum according to claim 1, wherein each type belt further includes two type portions which are blank thereby separating into two groups the type portions having characters thereon.

3. The printing drum according to claim 2, wherein the type portion having the projection forms an extension of one of the two blank type portions on one type belt.

4. A compact printer, comprising:

a cylindrically shaped printing drum having a peripheral surface with a plurality of apertures disposed therein;

a least two printing type belts mounted around the peripheral surface of said drum and being spaced apart by a predetermined distance, each type belt having a plurality of selectively usable character type portions and two blank type portions to separate the character type portions into two groups, and a projection which is integrally formed thereon and extends in an axial direction of the drum, wherein the projection of one of said type belts extends into the space between said belts, wherein the character is provided on the projection;

a plurality of projections provided on an inner side of each type portion for fitting into the plurality of apertures;

a plurality of hammers in said drum in side by side relation along the axial direction of said drum, for pressing said plurality of projections; and a pair of ink rollers for applying different color inks to each of the two groups of character type portions of each type belt.

* * * * *

UNITED STATES PATENT AND TRADEMARK OFFICE

CERTIFICATE OF CORRECTION

PATENT NO. : 4,475,828

DATED : October 9, 1984

INVENTOR(S) : TATSUO NISHIKAWA

It is certified that error appears in the above-identified patent and that said Letters Patent is hereby corrected as shown below:

Col. 2, line 62, change "an" to --a--.

Col. 3, line 43, change "his" to --has--;

line 67, change "other" to --another--.

Col. 5, line 8, change "is" to -- , --;

line 53, change "evennumber" to --even number--.

Col. 8, line 55, change "46b" to --45b--.

Col. 10, line 38, change "55b" (second occurrence) to --56b--.

Col. 12, line 36, change "a" to --at--.

Signed and Sealed this

Third Day of September 1985

[SEAL]

*Attest:*

DONALD J. QUIGG

*Attesting Officer* *Acting Commissioner of Patents and Trademarks - Designate*